US011155394B2

(12) United States Patent
Black et al.

(10) Patent No.: US 11,155,394 B2
(45) Date of Patent: Oct. 26, 2021

(54) FLEXIBLE CONTAINER

(71) Applicant: Dow Global Technologies LLC, Midland, MI (US)

(72) Inventors: Marc S. Black, Midland, MI (US); Simon Tage Jespersen, Rueschlikon (CH); Chad V. Schuette, Freeland, MI (US); Muhammad Ali Siddiqui, Waedenswil (CH); Haley A. Lowry, Houston, TX (US); Fabrice Digonnet, Fallanden (CH); Brian W. Walther, Clute, TX (US); Jeffrey E. Bonekamp, Midland, MI (US)

(73) Assignee: Dow Global Technologies LLC, Midland, MI (US)

( * ) Notice: Subject to any disclaimer, the term of this patent is extended or adjusted under 35 U.S.C. 154(b) by 30 days.

(21) Appl. No.: 16/604,474

(22) PCT Filed: Apr. 23, 2018

(86) PCT No.: PCT/US2018/028797
§ 371 (c)(1),
(2) Date: Oct. 10, 2019

(87) PCT Pub. No.: WO2018/200351
PCT Pub. Date: Nov. 1, 2018

(65) Prior Publication Data

US 2020/0047962 A1 Feb. 13, 2020

Related U.S. Application Data

(60) Provisional application No. 62/489,189, filed on Apr. 24, 2017.

(51) Int. Cl.
*B65D 30/20* (2006.01)
*B65D 75/00* (2006.01)
(Continued)

(52) U.S. Cl.
CPC ..... *B65D 75/008* (2013.01); *B65D 31/10* (2013.01); *B65D 33/08* (2013.01); *B65D 75/5883* (2013.01)

(58) Field of Classification Search
CPC .. B65D 7/008; B65D 75/008; B65D 75/5883; B65D 31/10
(Continued)

(56) References Cited

U.S. PATENT DOCUMENTS 5,352,043 A * 10/1994 Takagaki ..... B65D 75/008 383/104
5,783,638 A 7/1998 Lai et al.
(Continued)

FOREIGN PATENT DOCUMENTS

CN 201371998 Y 12/2009
JP 11091798 A * 4/1999 ..... B65D 75/5883
(Continued)

*Primary Examiner* — Jes F Pascua
*Assistant Examiner* — Nina K Attel
(74) *Attorney, Agent, or Firm* — Quarles & Brady LLP

(57) ABSTRACT

The present disclosure provides a flexible container. In an embodiment, the flexible container includes (A) a front panel, a rear panel, a first gusseted side panel, and a second gusseted side panel. The gusseted side panels adjoin the front panel and the rear panel along peripheral seals to form a chamber. (B) Each peripheral seal has (i) a body seal inner edge (BSIE) with a bottom end and an opposing top end, (ii) a bottom tapered seal inner edge (b-TSIE) extending from the BSIE bottom end, and (iii) a top tapered seal inner edge (t-TSIE) extending from the BSIE top end. (C) The t-TSIE has a length that is at least 1.1 times greater than the length of the BSIE (in mm).

10 Claims, 7 Drawing Sheets

(51) Int. Cl.
*B65D 33/08* (2006.01)
*B65D 75/58* (2006.01)

(58) Field of Classification Search
USPC ..... 383/36
See application file for complete search history.

(56) References Cited

U.S. PATENT DOCUMENTS

| | | | | |
|---|---|---|---|---|
| 6,102,568 | A | 8/2000 | Davis | |
| 6,164,822 | A | 12/2000 | Beer | |
| 7,942,578 | B2 | 5/2011 | Andersen | |
| 2011/0069908 | A1* | 3/2011 | Wilkes | B65D 75/008 383/10 |
| 2013/0177265 | A1* | 7/2013 | Bhattacharjee | B29C 66/81427 383/121 |
| 2014/0199002 | A1 | 1/2014 | Deluca et al. | |
| 2015/0121810 | A1 | 5/2015 | Bourgeois et al. | |
| 2015/0122846 | A1 | 5/2015 | Stanley et al. | |
| 2015/0314919 | A1 | 11/2015 | Wilkes et al. | |
| 2016/0016695 | A1* | 1/2016 | Pereira | B29C 66/3452 383/6 |
| 2016/0280439 | A1 | 9/2016 | Murray | |
| 2016/0304254 | A1 | 10/2016 | Bonekamp et al. | |
| 2018/0253686 | A1 | 9/2018 | Fallgren et al. | |

FOREIGN PATENT DOCUMENTS

| | | | | |
|---|---|---|---|---|
| JP | 11147547 A * | 6/1999 | | B65D 75/5883 |
| JP | 11208676 A * | 8/1999 | | B65D 75/5883 |
| WO | 95/13224 A1 | 5/1995 | | |

* cited by examiner

FLEXIBLE CONTAINER

BACKGROUND

The present disclosure is directed to a flexible container for dispensing a flowable material.

Known are flexible containers with a gusseted body section. These gusseted flexible containers are currently produced using flexible films which are folded to form gussets and heat sealed in a perimeter shape. The gusseted body section opens to form a flexible container with a square cross section or a rectangular cross section. The gussets are terminated at the bottom of the container to form a substantially flat base, providing stability when the container is partially or wholly filled. The flat base yields a self-standing flexible container, otherwise known as a stand-up pouch, or "SUP."

Performance attributes for SUPs include aspect ratio, stability, and drop strength. The aspect ratio is the relationship between the container height and the container width. The stability of the SUP is the ability of the filled flexible container to stand upright without tipping or leaning. Drop strength is the resistance of the filled flexible container to breakage or leakage when dropped. A larger aspect ratio (i.e., a taller flexible container) is oftentimes desirable in the retail setting, for example, because a larger aspect ratio translates into effective shelf space utilization and increased container advertising area, drawing consumer appeal to the SUP. However, as aspect ratio increases, SUP stability and/or SUP drop strength generally decreases. Maximizing SUP performance is characterized by these relationships.

The art recognizes the need for self-standing flexible containers (SUPs) with an increased aspect ratio without degradation to stability and/or without degradation to drop strength. Further desired in the art is an SUP with increased aspect ratio and sufficient drop strength to operate in the retail, commercial, industrial, and/or household environments.

SUMMARY

The present disclosure provides a flexible container. In an embodiment, the flexible container includes (A) a front panel, a rear panel, a first gusseted side panel, and a second gusseted side panel. The gusseted side panels adjoin the front panel and the rear panel along peripheral seals to form a chamber. (B) Each peripheral seal has (i) a body seal inner edge (BSIE) with a bottom end and an opposing top end, (ii) a bottom tapered seal inner edge (b-TSIE) extending from the BSIE bottom end, and (iii) a top tapered seal inner edge (t-TSIE) extending from the BSIE top end. (C) The t-TSIE has a length that is at least 1.1 times greater than the length of the BSIE (in mm).

DEFINITIONS AND TEST METHODS

Figure 1:
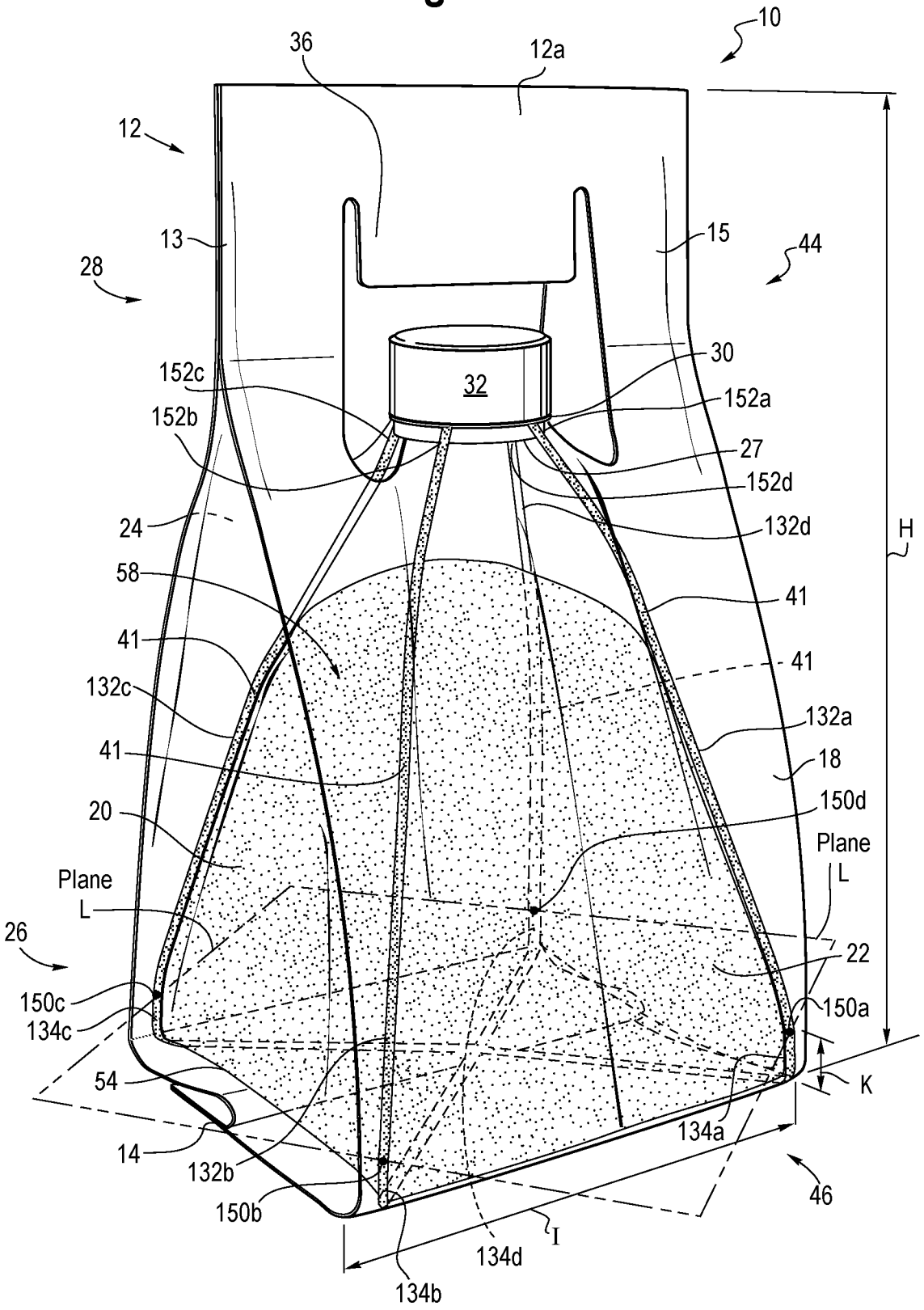
FIG. 1 is a perspective view of a filled self-standing flexible container having top and bottom flexible handles in accordance with an embodiment of the present disclosure.

The numerical ranges disclosed herein include all values from, and including, the lower value and the upper value. For ranges containing explicit values (e.g., 1, or 2, or 3 to 5, or 6, or 7) any subrange between any two explicit values is included (e.g., 1 to 2; 2 to 6; 5 to 7; 3 to 7; 5 to 6; etc.).

Unless stated to the contrary, implicit from the context, or customary in the art, all parts and percents are based on weight, and all test methods are current as of the filing date of this disclosure.

The term "composition," as used herein, refers to a mixture of materials which comprise the composition, as well as reaction products and decomposition products formed from the materials of the composition.

The terms "comprising," "including," "having," and their derivatives, are not intended to exclude the presence of any additional component, step or procedure, whether or not the same is specifically disclosed. In order to avoid any doubt, all compositions claimed through use of the term "comprising" may include any additional additive, adjuvant, or compound, whether polymeric or otherwise, unless stated to the contrary. In contrast, the term, "consisting essentially of" excludes from the scope of any succeeding recitation any other component, step or procedure, excepting those that are not essential to operability. The term "consisting of" excludes any component, step or procedure not specifically delineated or listed.

An "ethylene-based polymer," as used herein is a polymer that contains more than 50 weight percent polymerized ethylene monomer (based on the total amount of polymerizable monomers) and, optionally, may contain at least one comonomer.

The term "heat seal initiation temperature," is minimum sealing temperature required to form a seal of significant strength, in this case, 2 lb/in (8.8N/25.4 mm). The seal is performed in a Topwave HT tester with 0.5 seconds dwell time at 2.7 bar (40 psi) seal bar pressure. The sealed specimen is tested in an Instron Tensioner at 10 in/min (4.2 mm/sec or 250 mm/min).

Tm or "melting point" as used herein (also referred to as a melting peak in reference to the shape of the plotted DSC curve) is typically measured by the DSC (Differential Scanning Calorimetry) technique for measuring the melting points or peaks of polyolefins as described in U.S. Pat. No. 5,783,638. It should be noted that many blends comprising two or more polyolefins will have more than one melting point or peak, many individual polyolefins will comprise only one melting point or peak.

Moisture permeability is a normalized calculation performed by first measuring Water Vapor Transmission Rate (WVTR) of the film and then multiplying WVTR by the film thickness (usually thickness in units of mil). WVTR is measured at 38° C., 100% relative humidity and 1 atm pressure with a MOCON Permatran-W 3/31. For values of WVTR at 90% relative humidity the measured WVTR (at 100% relative humidity) is multiplied by 0.90. The instrument is calibrated with National Institute of Standards and Technology certified 25 μm-thick polyester film of known water vapor transport characteristics. The specimens are prepared and the WVTR is performed according to ASTM F1249. WVTR units are $g/m^2/24$ hr.

An "olefin-based polymer," as used herein is a polymer that contains more than 50 weight percent polymerized olefin monomer (based on total amount of polymerizable monomers), and optionally, may contain at least one comonomer. Nonlimiting examples of olefin-based polymer include ethylene-based polymer and propylene-based polymer.

Oxygen permeability is a normalized calculation performed by first measuring Oxygen Transmission Rate (OTR) for a given film thickness and then multiplying this measured OTR by the film thickness (usually thickness in units of mil). OTR is measured at 23° C., 50% relative humidity and 1 atm pressure with a MOCON OX-TRAN 2/20. The instrument is calibrated with National Institute of Standards and Technology certified Mylar film of known $O_2$ transport characteristics. The specimens are prepared and the OTR is performed according to ASTM D 3985. Typical OTR units are $cc/m^2/24$ hr/atm.

A "polymer" is a compound prepared by polymerizing monomers, whether of the same or a different type, that in polymerized form provide the multiple and/or repeating "units" or "mer units" that make up a polymer. The generic term polymer thus embraces the term homopolymer, usually employed to refer to polymers prepared from only one type of monomer, and the term copolymer, usually employed to refer to polymers prepared from at least two types of monomers. It also embraces all forms of copolymer, e.g., random, block, etc. The terms "ethylene/α-olefin polymer" and "propylene/α-olefin polymer" are indicative of copolymer as described above prepared from polymerizing ethylene or propylene respectively and one or more additional, polymerizable α-olefin monomer. It is noted that although a polymer is often referred to as being "made of" one or more specified monomers, "based on" a specified monomer or monomer type, "containing" a specified monomer content, or the like, in this context the term "monomer" is understood to be referring to the polymerized remnant of the specified monomer and not to the unpolymerized species. In general, polymers herein are referred to has being based on "units" that are the polymerized form of a corresponding monomer.

A "propylene-based polymer" is a polymer that contains more than 50 weight percent polymerized propylene monomer (based on the total amount of polymerizable monomers) and, optionally, may contain at least one comonomer.

DETAILED DESCRIPTION

The present disclosure provides a flexible container. In an embodiment, the flexible container includes (A) a front panel, a rear panel, a first gusseted side panel, and a second gusseted side panel. The gusseted side panels adjoin the front panel and the rear panel along peripheral seals to form a chamber. (B) Each peripheral seal has (i) a body seal inner edge (BSIE) with a bottom end and an opposing top end. (ii) A bottom tapered seal inner edge (b-TSIE) extends from the BSIE bottom end. (iii) A top tapered seal inner edge (t-TSIE) extends from the BSIE top end. (C) The t-TSIE has a length that is at least 1.1 times greater than the length of the BSIE (in millimeters, or mm).

Figure 2:
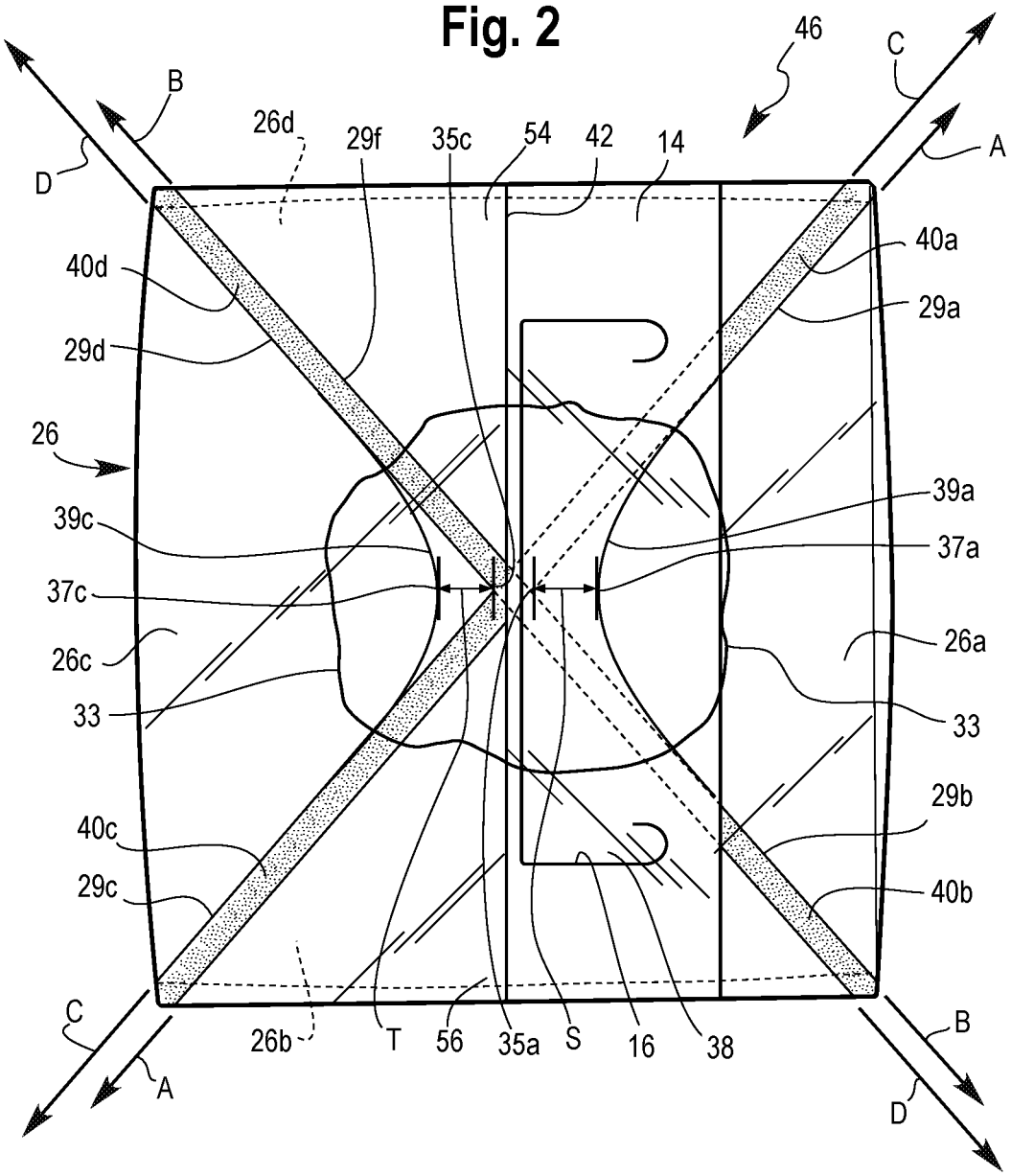
FIG. 2 is a bottom plan view of the flexible container of FIG. 1.

FIGS. 1-2 show a flexible container 10 having a flexible top 12 and a bottom 14. The flexible container 10 has four panels, a front panel 22, a back panel 24, a first gusset panel 18 and a second gusset panel 20. The four panels 18, 20, 22, and 24 extend toward a top end 44 and a bottom end 46 of the flexible container 10 to form the top segment 28 and bottom segment 26, respectively. When the flexible container 10 is inverted, the top and bottom positions in relation to the container 10 change. However, for consistency the handle adjacent the spout 30 will be called the top or upper handle 12 and the opposite handle will be called the bottom or lower handle 14. Likewise, the top segment will be the surface adjacent the spout 30, and the bottom segment will be the surface opposite the top segment.

The four panels 18, 20, 22 and 24 each can be composed of a separate web of film. The composition and structure for each web of film can be the same or different. Alternatively, one web of film may also be used to make all four panels and the top and bottom segments. In a further embodiment, two or more webs can be used to make each panel.

In an embodiment, four webs of multilayer film are provided, one web of multilayer film for each respective panel 18, 20, 22, and 24. The edges of each multilayer film are sealed to the adjacent web of film to form peripheral seals 41 (FIG. 1). Peripheral tapered seals 40*a*-40*d* are located on the bottom segment 26 of the container as shown in FIG. 2. The peripheral seals 41 are located on the side edges of the container 10. The sealed panels 18, 20, 22, 24 from an interior chamber.

To form the top segment 28 and the bottom segment 26, the four webs of film converge together at the respective end and are sealed together. For instance, the top segment 28 can be defined by extensions of the panels sealed together at the top end 44 and when the flexible container 10 is in a rest position it can have four top panels 28*a*-28*d* (FIG. 4) of film that define the top segment 28. The bottom segment 26 can also have four bottom panels 26*a*-26*d* of film sealed together and can also be defined by extensions of the panels at the opposite end 46 as shown in FIG. 2.

In an embodiment, a portion of each of the four panels 18, 20, 22, 24 (front panel, rear panel, first gusseted side panel, second gusseted side panel) form the top segment 28 and terminate at a neck 27. In this way, each panel extends from the bottom segment to the neck 27. At the neck 27, a portion of a top end section of each of the four panels 18, 20, 22, 24 is sealed, or otherwise is welded, to a spout 30 to form a tight seal. The spout 30 is sealed to the neck 27 by way of compression heat seal, ultrasonic seal, and combinations thereof. Although the base of spout 30 has a circular cross-sectional shape, it is understood that the base of spout 30 can have other cross-sectional shapes such as a polygonal cross-sectional shape, for example. The base with circular cross-sectional shape is distinct from fitments with canoe-shaped bases used for conventional two-panel flexible pouches.

In an embodiment, the outer surface of the base of spout 30 has surface texture. The surface texture can include embossment and a plurality of radial ridges to promote sealing to the inner surface of the top segment 28.

In an embodiment, the spout 30 excludes fitments with oval, wing-shaped, eye-shaped, or canoe-shaped bases.

Furthermore, the spout 30 can contain a removable closure 32. Alternatively, the spout 30 can be positioned on one of the panels, where the top segment would then be defined as an upper seal area defined by the joining together of at least two panel ends. In a further embodiment, the spout 30 is positioned at generally a midpoint of the top segment 28 and can be sized smaller than a width of the container 10, such that the spout 30 can have an area that is less than a total area of the top segment 28. In yet a further embodiment, the spout area is not more than 20% of the total top segment area. This can ensure that the spout 30 will not be large enough to insert a hand therethrough, thus avoiding any unintentional contact with the product 58 stored therein.

The spout 30 can be made of a rigid construction and can be formed of any appropriate plastic, such as high density polyethylene (HDPE), low density polyethylene (LDPE), polypropylene (PP), and combinations thereof. The location of the spout 30 can be anywhere on the top segment 28 of the container 10. In an embodiment, the spout 30 is located at the center or midpoint of the top segment 28. The closure 32 covers the spout 30 and prevents the product from spilling out of the container 10. The closure 32 may be a screw-on cap, a flip-top cap or other types of removable (and optionally reclosable) closures.

In an embodiment, the flexible container does not have a rigid spout and the panels are sealed across the neck, by way of a releasable seal (tear seal), for example.

As shown in FIGS. 1-2, the flexible bottom handle 14 can be positioned at a bottom end 46 of the container 10 such that the bottom handle 14 is an extension of the bottom segment 26.

Each panel includes a respective bottom face. FIG. 2 shows four triangle-shaped bottom faces 26*a*, 26*b*, 26*c*, 26*d*, each bottom face being an extension of a respective film panel. The bottom faces 26*a*-26*d* make up the bottom segment 26. The four panels 26*a*-26*d* come together at a midpoint of the bottom segment 26. The bottom faces 26*a*-26*d* are sealed together, such as by using a heat-sealing technology, to form the bottom handle 14. For instance, a weld can be made to form the bottom handle 14, and to seal the edges of the bottom segment 26 together. Nonlimiting examples of suitable heat-sealing technologies include hot bar sealing, hot die sealing, impulse sealing, high frequency sealing, or ultrasonic sealing methods.

Figure 3:
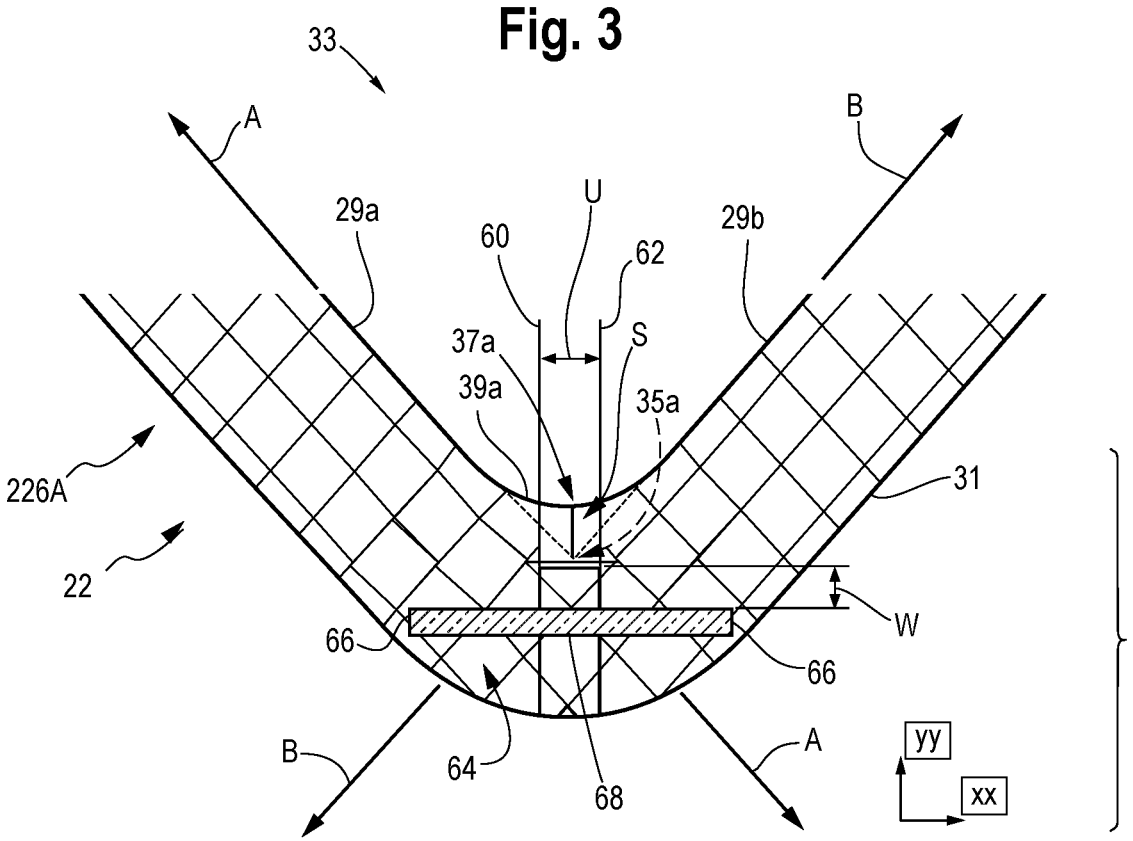
FIG. 3 is an enlarged view of the bottom seal area of FIG. 5.
Figure 5:
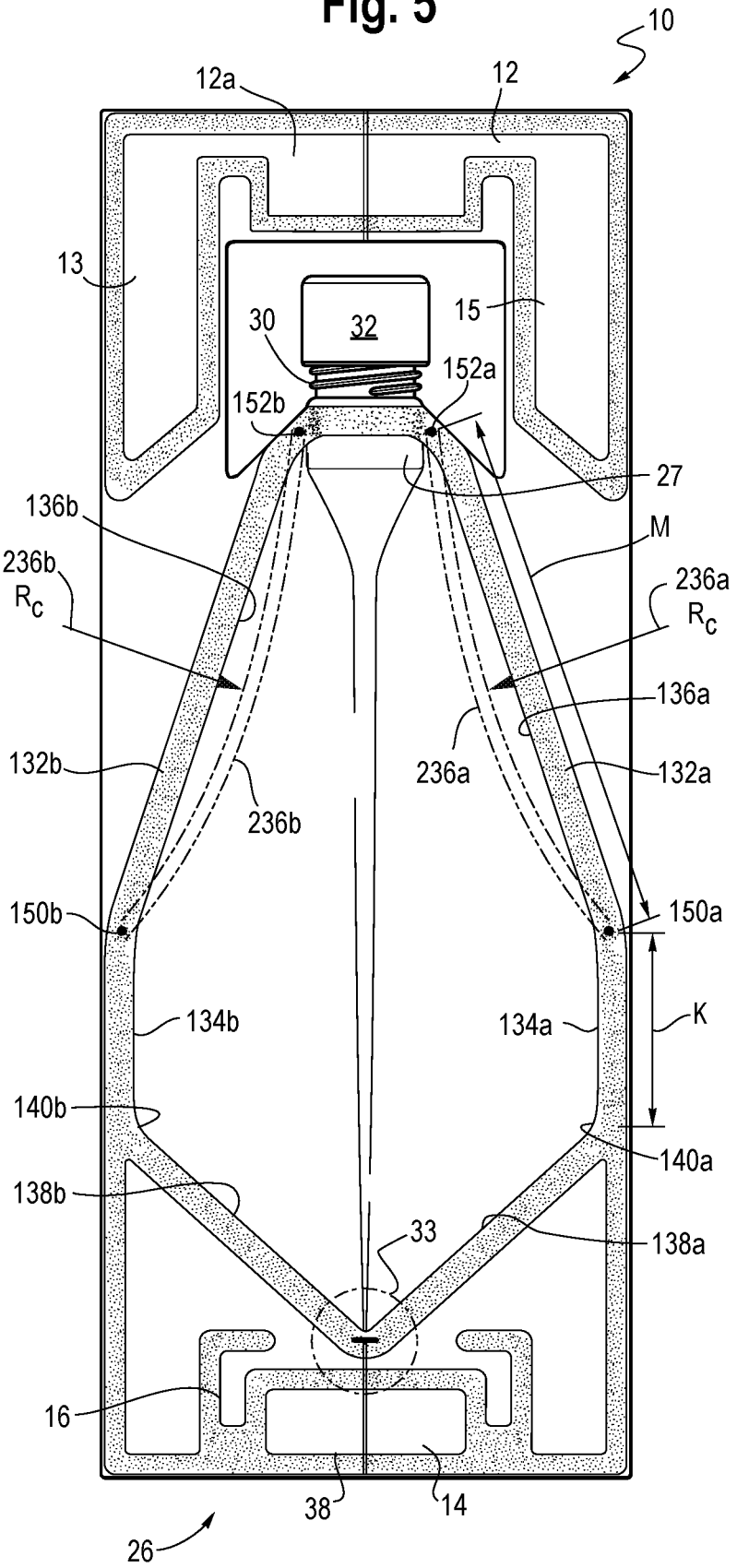
FIG. 5 is a perspective view of the container of FIG. 1 in a collapsed configuration.

FIG. 2 shows bottom segment 26. Each panel 18, 20, 22, 24 has a respective bottom face 26*a*, 26*b*, 26*c*, 26*d* that is present in the bottom segment 26. Each bottom face is bordered by two opposing peripheral tapered seals 40*a*, 40*b*, 40*c*, 40*d*. Each peripheral tapered seal 40*a*-40*d* extends from a respective peripheral seal 41. The peripheral tapered seals for the front panel 22 and the rear panel 24 have an inner edge 29*a*-29*d* (FIG. 2) and an outer edge 31 (FIG. 3). The peripheral tapered seals 40*a*-40*d* converge at a bottom seal area 33 (FIG. 2, FIG. 3, FIG. 5).

The front panel bottom face 26*a* includes a first line A defined by the inner edge 29*a* of the first peripheral tapered seal 40*a* and a second line B defined by the inner edge 29*b* of the second peripheral tapered seal 40*b*. The first line A intersects the second line B at an apex point 35*a* in the bottom seal area 33. The front panel bottom face 26*a* has a bottom distalmost inner seal point 37*a* ("BDISP 37*a*"). The BDISP 37*a* is located on an inner seal edge defined by inner edge 29*a* and inner edge 29*b*.

The apex point 35*a* is separated from the BDISP 37*a* by a distance S from 0 millimeter (mm) to less than 8.0 mm.

In an embodiment, the rear panel bottom face 26*c* includes an apex point similar to the apex point on the front panel bottom face. The rear panel bottom face 26*c* includes a first line C defined by the inner edge of the 29*c* first peripheral tapered seal 40*c* and a second line D defined by the inner edge 29*d* of the second peripheral tapered seal 40*d*. The first line C intersects the second line D at an apex point 35*c* in the bottom seal area 33. The rear panel bottom face 26*c* has a bottom distalmost inner seal point 37*c* ("BDISP 37*c*"). The BDISP 37*c* is located on an inner seal edge defined by inner edge 29*c* and inner edge 29*d*. The apex point 35*c* is separated from the BDISP 37*c* by a distance T from 0 millimeter (mm) to less than 8.0 mm.

It is understood the following description to the front panel bottom face applies equally to the rear panel bottom face, with reference numerals to the rear panel bottom face shown in adjacent closed parentheses.

In an embodiment, the BDISP 37*a* (37*c*) is located where the inner edges 29*a* (29*c*) and 29*b* (29*d*) intersect. The distance between the BDISP 37*a* (37*c*) and the apex point 35*a* (35*c*) is 0 mm.

In an embodiment, the inner seal edge diverges from the inner edges 29*a*, 29*b* (29*c*, 29*d*), to form a distal inner seal arc 39*a* (front panel) a distal inner seal arc 39*c* (rear panel) as shown in FIGS. 2 and 3. The BDISP 37*a* (37*c*) is located on the inner seal arc 39*a* (39*c*). The apex point 35*a* (apex point 35*c*) is separated from the BDISP 37*a* (BDISP 37*c*) by the distance S (distance T) which is from greater than 0 mm, or 1.0 mm, or 2.0 mm, or 2.6 mm, or 3.0 mm, or 3.5 mm, or 3.9 mm, to 4.0 mm, or 4.5 mm, or 5.0 mm, or 5.2 mm, or 5.3 mm, or 5.5 mm, or 6.0 mm, or 6.5 mm, or 7.0 mm, or 7.5 mm, or 7.9 mm.

In an embodiment, apex point 35*a* (35*c*) is separated from the BDISP 37*a* (37*c*) by the distance S (distance T) which is from greater than 0 mm to less than 6.0 mm.

In an embodiment, the distance from S (distance T) from the apex point 35*a* (35*c*) to the BDISP 37*a* (37*c*) is from greater than 0 mm, or 0.5 mm, or 1.0 mm, or 2.0 mm to 4.0 mm, or 5.0 mm, or less than 5.5 mm.

In an embodiment, apex point 35*a* (apex point 35*c*) is separated from the BDISP 37*a* (BDISP 37*c*) by the distance S (distance T) which is from 3.0 mm, or 3.5 mm, or 3.9 mm to 4.0 mm, or 4.5 mm, or 5.0 mm, or 5.2 mm, or 5.3 mm, or 5.5 mm.

In an embodiment, the distal inner seal arc 39*a* (39*c*) has a radius of curvature from 0 mm, or greater than 0 mm, or 1.0 mm to 19.0 mm, or 20.0 mm.

The bottom segment 26 includes a pair of gussets 54 and 56 formed thereat, which are essentially extensions of the bottom faces 26*a*-26*d*. The gussets 54 and 56 can facilitate the ability of the flexible container 10 to stand upright. These gussets 54 and 56 are formed from excess material from each bottom face 26*a*-26*d* that are joined together to form the gussets 54 and 56. The triangular portions of the gussets 54 and 56 comprise two adjacent bottom segment panels sealed together and extending into its respective gusset. For example, adjacent bottom faces 26*a* and 26*d* extend beyond the plane of their bottom surface along an intersecting edge and are sealed together to form one side of a first gusset 54. Similarly, adjacent bottom faces 26*c* and 26*d* extend beyond the plane of their bottom surface along an intersecting edge and are sealed together to form the other side of the first gusset 54. Likewise, a second gusset 56 is similarly formed from adjacent bottom faces 26*a*-26*b* and 26*b*-26*c*. The gussets 54 and 56 can contact a portion of the bottom segment 26, where the gussets 54 and 56 can contact bottom faces 26*b* and 26*d* covering them, while bottom segment panels 26*a* and 26*c* remain exposed at the bottom end 46.

As shown in FIGS. 1-2, the gussets 54 and 56 of the flexible container 10 can further extend into the bottom handle 14. In the aspect where the gussets 54 and 56 are positioned adjacent bottom segment panels 26*b* and 26*d*, the bottom handle 14 can also extend across bottom faces 26*b* and 26*d*, extending between the pair of panels 18 and 20. The bottom handle 14 can be positioned along a center portion or midpoint of the bottom segment 26 between the front panel 22 and the rear panel 24.

The bottom handle 14 can comprise up to four layers of film (one layer for each panel 18, 20, 22, 24) sealed together when four webs of film are used to make the container 10.

When more than four webs are used to make the container, the handle will include the same number of webs used to produce the container. Any portion of the bottom handle 14 where all four layers are not completely sealed together by the heat-sealing method, can be adhered together in any appropriate manner, such as by a tack seal to form a fully-sealed multi-layer bottom handle 14. The bottom handle 14 can have any suitable shape and generally will take the shape of the film end. For example, typically the web of film has a rectangular shape when unwound, such that its ends have a straight edge. Therefore, the bottom handle 14 would also have a rectangular shape.

Additionally, the bottom handle 14 can contain a handle opening 16 or cutout section therein sized to fit a user's hand. The opening 16 can be any shape that is convenient to fit the hand and, in one aspect, the opening 16 can have a generally oval shape. In another aspect, the opening 16 can have a generally rectangular shape. Additionally, the opening 16 of the bottom handle 14 can also have a flap 38 that comprises the cut material that forms the opening 16. To define the opening 16, the handle 14 can have a section that is cut out of the multilayer handle 14 along three sides or portions while remaining attached at a fourth side or lower portion. This provides a flap of material 38 that can be pushed through the opening 16 by the user and folded over an edge of the opening 16 to provide a relatively smooth gripping surface at an edge that contacts the user's hand. If the flap of material were completely cut out, this would leave an exposed fourth side or lower edge that could be relatively sharp and could possibly cut or scratch the hand when placed there.

Furthermore, a portion of the bottom handle 14 attached to the bottom segment 26 can contain a dead machine fold 42 or a score line that provides for the handle 14 to consistently fold in the same direction, as illustrated in FIG. 2. The machine fold 42 can comprise a fold line that permits folding in a first direction toward the front side panel 22 and restricts folding in a second direction toward the rear panel 24. The term "restricts" as used throughout this application can mean that it is easier to move in one direction, or the first direction, than in an opposite direction, such as the second direction. The machine fold 42 can cause the handle 14 to consistently fold in the first direction because it can be thought of as providing a generally permanent fold line in the handle that is predisposed to fold in the first direction. This machine fold 42 of the bottom handle 14 can serve multiple purposes, one being that when a user is transferring the product from the container 10 they can grasp the bottom handle 14 and it will easily bend in the first direction to assist in pouring. Secondly, when the flexible container 10 is stored in an upright position, the machine fold 42 in the bottom handle 14 encourages the handle 14 to fold in the first direction along the machine fold 42, such that the bottom handle 14 can fold underneath the container 10 adjacent one of the bottom segment panels 26*a*, as shown in FIG. 2. The weight of the product can also apply a force to the bottom handle 14, such that the weight of the product can further press on the handle 14 and maintain the handle 14 in the folded position in the first direction. In an embodiment, the top handle 12 can also contain a similar machine fold 34*a*-34*b* that also allows it to fold consistently in the same first direction as the bottom handle 14.

Additionally, as the flexible container 10 is evacuated and less product remains, the bottom handle 14 can continue to provide support to help the flexible container 10 to remain standing upright unsupported and without tipping over. Because the bottom handle 14 is sealed generally along its entire length extending between the pair of side panels 18 and 20, it can help to keep the gussets 54 and 56 (FIG. 1, FIG. 2) together and continue to provide support to stand the container 10 upright even as the container 10 is emptied.

Figure 4:
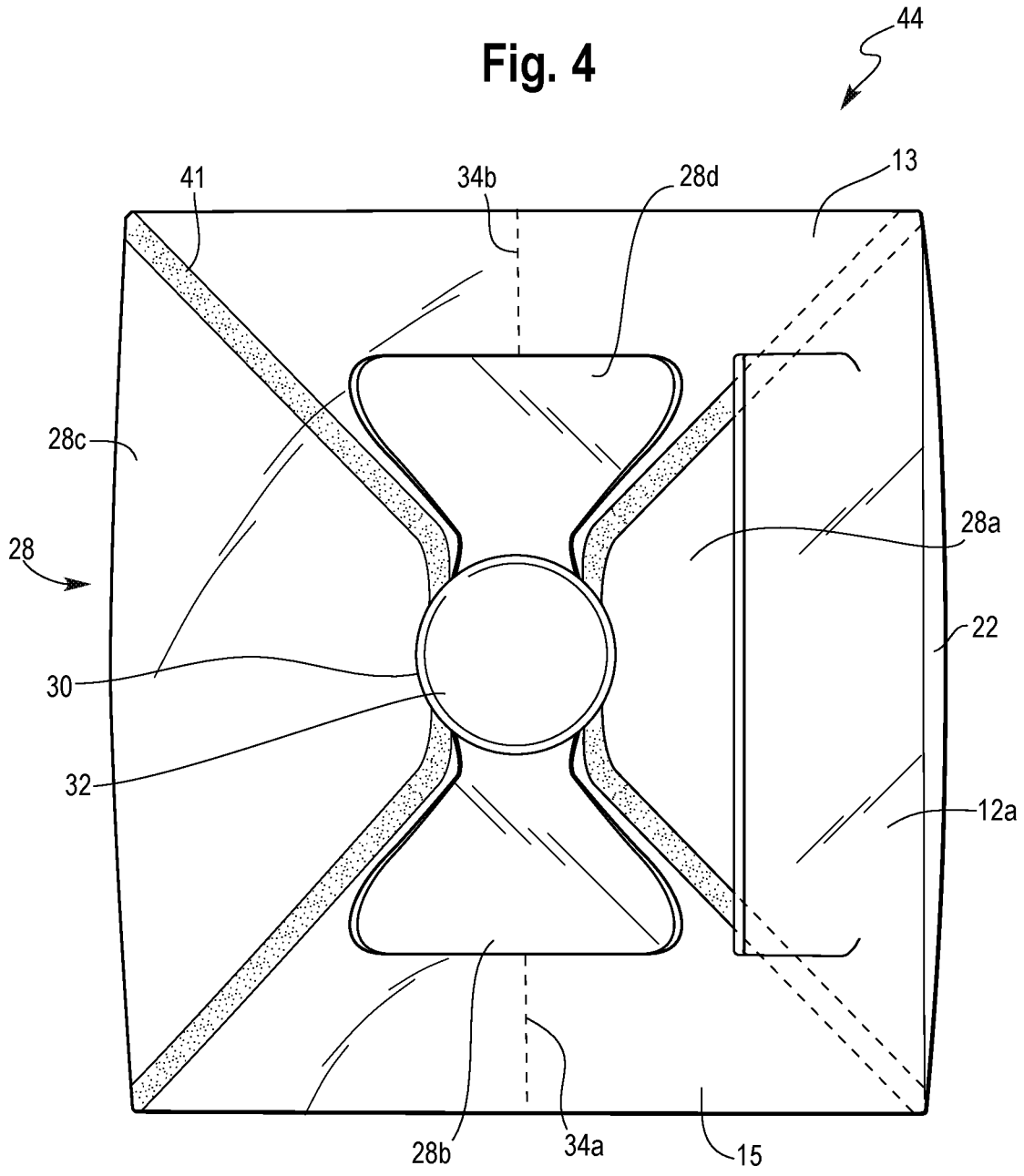
FIG. 4 is a top plan view of the flexible container of FIG. 1.

As seen in FIGS. 1 and 5, the top handle 12 extends vertically, or substantially vertically, upward from the top segment 28 and, in particular, can extend from the four panels 28*a*-28*d* that make up the top segment 28. As shown in FIGS. 1 and 4, the four panels 28*a*-28*d* of film that extend into the top handle 12 are all sealed together to form a multi-layer top handle 12. The top handle 12 can have a U-shape and, in particular, an upside down U-shape with a horizontal upper handle portion 12*a* having a pair of spaced legs 13 and 15 extending therefrom. The legs 13 and 15 extend from the top segment 28, adjacent the spout 30 with one leg 13 on one side of the spout 30 and other leg 15 on the other side of the spout 30, with each leg 13, 15 extending from opposite portions of the top segment 28.

The bottommost edge of the upper handle portion 12*a* when extended in a position above the spout 30, is tall enough to clear the uppermost edge of the spout 30. A portion of the top handle 12 can extend above the spout 30 and above the top segment 28 when the handle 12 is extended in a position perpendicular to the top segment 28 and, in particular, the entire upper handle portion 12*a* can be above the spout 30 and the top segment 28. The two pairs of legs 13 and 15 along with the upper handle portion 12*a* together make up the handle 12 surrounding a handle opening that allows a user to place her hand therethrough and grasp the upper handle portion 12*a* of the handle 12.

In an embodiment, the top handle is a stand-up top handle 12 as shown in FIG. 1. A "stand-up top handle," as used herein, is a top handle formed from the four panels and is fabricated (e.g., sealed) such that upper handle portion 12*a* is above the spout 30 when flexible container 10 is in the expanded configuration. The stand-up top handle 12 is formed to stand, or otherwise to extend vertically, or substantially vertically, upright from top segment 28 such that the horizontal upper handle portion 12*a* is positioned above the spout 30 without manipulation by a person. In this sense, the stand-up top handle is "self-standing."

In an embodiment, the top handle 12 can have a dead machine fold 34*a*-34*b* that permits folding in a first direction toward the front side panel 22 and restricts folding in a second direction toward the rear side panel 24. The machine fold 34*a*-34*b* can be located in each leg 13, 15 at a location where the seal begins. The handle 12 can be adhered together, such as with a tack adhesive, beginning from the machine folded portion 34*a*-34*b* up to and including the horizontal upper handle portion 12*a* of the handle 12. Alternatively, two machine folds 34*a*-34*b* in the handle 12 can allow for the handle 12 to be inclined to fold or bend consistently in the same first direction as the bottom handle 14, rather than in the second direction Y. As shown in FIG. 1, the handle 12 can likewise contain a flap portion 36, that folds upwards toward the upper handle portion 12*a* of the handle 12 to create a smooth gripping surface of the handle 12, as with the bottom handle 14, such that the handle material is not sharp and can protect the user's hand from getting cut on any sharp edges of the handle 12.

When the container 10 is in a rest position, such as when it is standing upright on its bottom segment 26, as shown in FIG. 1, the bottom handle 14 can be folded underneath the container 10 along the bottom machine fold 42 in the first direction, so that it is parallel to the bottom segment 26 and adjacent bottom panel 26*a*, and the top handle 12 extends straight up, with horizontal handle portion 12*a* above the spout 30. The flexible container 10 can stand upright even with the bottom handle 14 positioned underneath the upright flexible container 10.

In an embodiment, the flexible container can contain a fitment or pour spout positioned on a sidewall, where the top handle is essentially formed in and from the top portion or segment. The top handle can be formed from the four panels 18, 20, 22, 24, each panel extending from its respective sidewall, extending into a sidewall or flap positioned at the top end of the container, such that the top segment of the container converges into the handle and they are one and the same, with the spout to the side of the extended handles, rather than underneath.

The material of construction of the flexible container 10 can comprise a food-grade plastic. For instance, nylon, polypropylene, polyethylene such as high density polyethylene (HDPE) and/or low density polyethylene (LDPE) may be used as discussed later. The film of the flexible container 10 can have a thickness that is adequate to maintain product and package integrity during manufacturing, distribution, product shelf life and customer usage. In an embodiment, the flexible multilayer film for each panel has a thickness from 100 micrometers, or 200 micrometers, or 250 micrometers to 300 micrometers, or 350 micrometers, or 400 micrometers. The film material can also be such that it provides the appropriate atmosphere within the flexible container 10 to maintain the product shelf life of at least about 180 days. Such multilayer films can comprise an oxygen barrier film, such as a film having a low oxygen transmission rate (OTR) from 0, or greater than 0 to 0.4, or 1.0 cc/$m^2$/24 hrs/atm) at 23° C. and 80% relative humidity (RH). Additionally, the flexible multilayer film that forms each panel can also comprise a water vapor barrier film, such as a film having a low water vapor transmission rate (WVTR) from 0, or greater than 0, or 0.2, or 1.0 to 5.0, or 10.0, or 15.0 g/$m^2$/24 hrs at 38° C. and 90% RH. Moreover, it may be desirable to use materials of construction having oil and/or chemical resistance particularly in the seal layer, but not limited to just the seal layer. The flexible multilayer film can be either printable or compatible to receive a pressure sensitive label or other type of label for displaying of indicia on the flexible container 10.

In an embodiment, each panel 18, 20, 22, 24 is made from a flexible multilayer film having at least one, or at least two, or at least three layers. The flexible multilayer film is resilient, flexible, deformable, and pliable. The structure and composition of the flexible multilayer film for each panel may be the same or different. For example, each of the four panels can be made from a separate web, each web having a unique structure and/or unique composition, finish, or print. Alternatively, each of the four panels can be the same structure and the same composition.

In an embodiment, each panel 18, 20, 22, 24 is a flexible multilayer film having the same structure and the same composition.

The flexible multilayer film may be (i) a coextruded multilayer structure or (ii) a laminate, or (iii) a combination of (i) and (ii). In an embodiment, the flexible multilayer film has at least three layers: a seal layer, an outer layer, and a tie layer between. The tie layer adjoins the seal layer to the outer layer. The flexible multilayer film may include one or more optional inner layers disposed between the seal layer and the outer layer.

In an embodiment, the flexible multilayer film is a coextruded film having at least two, or three, or four, or five, or six, or seven to eight, or nine, or 10, or 11, or more layers. Some methods, for example, used to construct films are by cast co-extrusion or blown co-extrusion methods, adhesive lamination, extrusion lamination, thermal lamination, and coatings such as vapor deposition. Combinations of these methods are also possible. Film layers can comprise, in addition to the polymeric materials, additives such as stabilizers, slip additives, antiblocking additives, process aids, clarifiers, nucleators, pigments or colorants, fillers and reinforcing agents, and the like as commonly used in the packaging industry. It is particularly useful to choose additives and polymeric materials that have suitable organoleptic and or optical properties.

Nonlimiting examples of suitable polymeric materials for the seal layer include olefin-based polymer (including any ethylene/$C_3$-$C_{10}$ α-olefin copolymers linear or branched), propylene-based polymer (including plastomer and elastomer, random propylene copolymer, propylene homopolymer, and propylene impact copolymer), ethylene-based polymer (including plastomer and elastomer, high density polyethylene ("HDPE"), low density polyethylene ("LDPE"), linear low density polyethylene ("LLDPE"), medium density polyethylene ("MDPE"), ethylene-acrylic acid or ethylene-methacrylic acid and their ionomers with zinc, sodium, lithium, potassium, magnesium salts, ethylene vinyl acetate copolymers and blends thereof.

Nonlimiting examples of suitable polymeric material for the outer layer include those used to make biaxially or monoaxially oriented films for lamination as well as coextruded films. Some nonlimiting polymeric material examples are biaxially oriented polyethylene terephthalate (OPET), monoaxially oriented nylon (MON), biaxially oriented nylon (BON), and biaxially oriented polypropylene (BOPP). Other polymeric materials useful in constructing film layers for structural benefit are polypropylenes (such as propylene homopolymer, random propylene copolymer, propylene impact copolymer, thermoplastic polypropylene (TPO) and the like, propylene-based plastomers (e.g., VERSIFY™ or VISTAMAX™)), polyamides (such as Nylon 6, Nylon 6,6, Nylon 6,66, Nylon 6,12, Nylon 12 etc.), polyethylene norbornene, cyclic olefin copolymers, polyacrylonitrile, polyesters, copolyesters (such as PETG), cellulose esters, polyethylene and copolymers of ethylene (e.g., LLDPE based on ethylene octene copolymer such as DOWLEX™, blends thereof, and multilayer combinations thereof.

Nonlimiting examples of suitable polymeric materials for the tie layer include functionalized ethylene-based polymers such as ethylene-vinyl acetate ("EVA"), polymers with maleic anhydride-grafted to polyolefins such as any polyethylene, ethylene-copolymers, or polypropylene, and ethylene acrylate copolymers such an ethylene methyl acrylate ("EMA"), glycidyl containing ethylene copolymers, propylene and ethylene based olefin block copolymers (OBC) such as INTUNE™ (PP-OBC) and INFUSE™ (PE-OBC) both available from The Dow Chemical Company, and blends thereof.

The flexible multilayer film may include additional layers which may contribute to the structural integrity or provide specific properties. The additional layers may be added by direct means or by using appropriate tie layers to the adjacent polymer layers. Polymers which may provide additional mechanical performance such as stiffness or opacity, as well polymers which may offer gas barrier properties or chemical resistance can be added to the structure.

Nonlimiting examples of suitable material for the optional barrier layer include copolymers of vinylidene chloride and methyl acrylate, methyl methacrylate or vinyl chloride (e.g., SARAN resins available from The Dow Chemical Company); vinylethylene vinyl alcohol (EVOH), metal foil (such as aluminum foil). Alternatively, modified polymeric films such as vapor deposited aluminum or silicon oxide on such films as BON, OPET, or OPP, can be used to obtain barrier properties when used in laminate multilayer film.

In an embodiment, the flexible multilayer film includes a seal layer selected from LLDPE (sold under the trade name DOWLEX™ (The Dow Chemical Company)), single-site LLDPE (substantially linear, or linear, olefin polymers, including polymers sold under the trade name AFFINITY™ or ELITE™ (The Dow Chemical Company) for example, propylene-based plastomers or elastomers such as VERSIFY™ (The Dow Chemical Company), and blends thereof. An optional tie layer is selected from either ethylene-based olefin block copolymer PE-OBC (sold as INFUSE™) or propylene-based olefin block copolymer PP-OBC (sold as INTUNE™). The outer layer includes greater than 50 wt % of resin(s) having a melting point, Tm, that is from 25° C., to 30° C., or 40° C. or higher than the melting point of the polymer in the seal layer wherein the outer layer polymer is selected from resins such as VERSIFY or VISTAMAX, ELITE™, HDPE or a propylene-based polymer such as propylene homopolymer, propylene impact copolymer or TPO.

In an embodiment, the flexible multilayer film is coextruded.

In an embodiment, flexible multilayer film includes a seal layer selected from LLDPE (sold under the trade name DOWLEX™ (The Dow Chemical Company)), single-site LLDPE (substantially linear, or linear, olefin polymers, including polymers sold under the trade name AFFINITY™ or ELITE™ (The Dow Chemical Company) for example, propylene-based plastomers or elastomers such as VERSIFY™ (The Dow Chemical Company), and blends thereof. The flexible multilayer film also includes an outer layer that is a polyamide.

In an embodiment, the flexible multilayer film is a coextruded film, the seal layer is composed of an ethylene-based polymer, such as a linear or a substantially linear polymer, or a single-site catalyzed linear or substantially linear polymer of ethylene and an alpha-olefin monomer such as 1-butene, 1-hexene or 1-octene, having a Tm from 55° C. to 115° C. and a density from 0.865 to 0.925 g/cm$^3$, or from 0.875 to 0.910 g/cm$^3$, or from 0.888 to 0.900 g/cm$^3$ and the outer layer is composed of a polyamide having a Tm from 170° C. to 270° C.

In an embodiment, the flexible multilayer film is a coextruded film having at least five layers, the coextruded film having a seal layer composed of an ethylene-based polymer, such as a linear or substantially linear polymer, or a single-site catalyzed linear or substantially linear polymer of ethylene and an alpha-olefin comonomer such as 1-butene, 1-hexene or 1-octene, the ethylene-based polymer having a Tm from 55° C. to 115° C. and density from 0.865 to 0.925 g/cm$^3$, or from 0.875 to 0.910 g/cm$^3$, or from 0.888 to 0.900 g/cm$^3$ and an outermost layer composed of a polyamide having a Tm from 170° C. to 270° C.

In an embodiment, the flexible multilayer film is a coextruded film having at least seven layers. The seal layer is composed of an ethylene-based polymer, such as a linear or substantially linear polymer, or a single-site catalyzed linear or substantially linear polymer of ethylene and an alpha-olefin comonomer such as 1-butene, 1-hexene or 1-octene, the ethylene-based polymer having a Tm from 55° C. to 115° C. and density from 0.865 to 0.925 g/cm$^3$, or from 0.875 to 0.910 g/cm$^3$, or from 0.888 to 0.900 g/cm$^3$. The outer layer is a polyamide having a Tm from 170° C. to 270° C.

In an embodiment, the flexible multilayer film includes a seal layer composed of an ethylene-based polymer, or a linear or substantially linear polymer, or a single-site catalyzed linear or substantially linear polymer of ethylene and an alpha-olefin monomer such as 1-butene, 1-hexene or 1-octene, having a heat seal initiation temperature (HSIT) from 65° C. to less than 125° C. In a further embodiment, the seal layer of the flexible multilayer film has an HSIT from 65° C., or 70° C., or 75° C., or 80° C., or 85° C., or 90° C., or 95° C., or 100° C. to 105° C., or 110° C., or 115° C., or 120° C., or less than 125° C. Applicant discovered that the seal layer with an ethylene-based polymer with a HSIT from 65° C. to less than 125° C. advantageously enables the formation of secure seals and secure sealed edges around the complex perimeter of the flexible container. The ethylene-based polymer with HSIT from 65° C. to less than 125° C. is a robust sealant which also allows for better sealing to the rigid fitment which is prone to failure. The ethylene-based polymer with HSIT from 65° C. to 125° C. enables lower heat sealing pressure/temperature during container fabrication. Lower heat seal pressure/temperature results in lower stress at the fold points of the gusset, and lower stress at the union of the films in the top segment and in the bottom segment. This improves film integrity by reducing wrinkling during the container fabrication. Reducing stresses at the folds and seams improves the finished container mechanical performance. The low HSIT ethylene-based polymer seals at a temperature below what would cause the outer layer to be compromised.

In an embodiment, the flexible multilayer film is a coextruded five layer film, or a coextruded seven layer film having at least two layers containing an ethylene-based polymer. The ethylene-based polymer may be the same or different in each layer.

In an embodiment, the flexible multilayer film is a coextruded five layer, or a coextruded seven layer film having at least two layers containing a polyamide polymer.

In an embodiment, the flexible multilayer film is a seven-layer coextruded film with a seal layer composed of an ethylene-based polymer, or a linear or substantially linear polymer, or a single-site catalyzed linear or substantially linear polymer of ethylene and an alpha-olefin monomer such as 1-butene, 1-hexene or 1-octene, having a Tm from 90° C. to 104° C. The outer layer is a polyamide having a Tm from 170° C. to 270° C. The film has an inner layer (first inner layer) composed of a second ethylene-based polymer, different than the ethylene-based polymer in the seal layer. The film has an inner layer (second inner layer) composed of a polyamide the same or different to the polyamide in the outer layer. The seven layer film has a thickness from 100 micrometers to 250 micrometers.

Flexible container 10 has an expanded configuration (shown in FIGS. 1-4) and a collapsed configuration as shown in FIG. 5. When the container 10 is in the collapsed configuration, the flexible container is in a flattened, or in an otherwise evacuated state. The gusset panels 18, 20 fold inwardly (dotted lines of FIG. 5) and are sandwiched by the front panel 22 and the rear panel 24.

FIG. 3 shows an enlarged view of the bottom seal area 33 of FIGS. 3 and 5 and the front panel 26*a*. The fold lines 60 and 62 of respective gusset panels 18, 20 are separated by a distance U that is from 0 mm, or 0.5 mm, or 1.0 mm, or 2.0 mm to 12.0 mm, or 60 mm, or greater than 60 mm. In an embodiment, distance U varies based on the size and volume of the flexible container 10. For example, the flexible container 10 may have a distance U (in mm) that is from greater than 0 mm to three times the volume (in liters) of the container. For example, a 2-liter flexible container can have a distance U from greater than 0 to less than or equal to 6.0 mm. In another example, a 20-liter flexible container 10 has a distance U that is from greater than 0 mm to less than or equal to 60 mm.

FIG. 3 shows line A (defined by inner edge 29*a*) intersecting line B (defined by inner edge 29*b*) at apex point 35*a*. BDISP 37*a* is on the distal inner seal arc 39*a*. Apex point 35*a* is separated from BDISP 37*a* by distance S having a length from greater than 0 mm, or 1.0 mm, or 2.0 mm, or 2.6 mm, or 3.0 mm, or 3.5 mm, or 3.9 mm to 4.0 mm, or 4.5 mm, or 5.0 mm, or 5.2 mm, or 5.5 mm, or 6.0 mm, or 6.5 mm, or 7.0 mm, or 7.5 mm, or 7.9 mm.

In FIG. 3, an overseal 64 is formed where the four peripheral tapered seals 40*a*-40*d* converge in the bottom seal area. The overseal 64 includes 4-ply portions 66, where a portion of each panel (18, 20, 22, 24) is heat sealed to a portion of every other panel. Each panel represents 1-ply in the 4-ply heat seal. The overseal 64 also includes a 2-ply portion 68 where two panels (front panel 22 and rear panel 24) are sealed together. Consequently, the "overseal," as used herein, is the area where the peripheral tapered seals converge and that is subjected to a subsequent heat seal operation (and subjected to at least two heat seal operations altogether). The overseal 64 is located in the peripheral tapered seals and does not extend into the chamber of the flexible container 10. Each panel 18, 20, 22, 24 extends from the bottom seal area 33 to the neck 27, each panel sealed to the spout 30. In an embodiment, each panel 18, 20, 22, 24 extends from the overseal 64 to the neck 27, each panel sealed to the spout 30.

In an embodiment, the apex point 35*a* is located above the overseal 64. The apex point 35*a* is separated from, and does not contact the overseal 64. The BDISP 37*a* is located above the overseal 64. The BDISP 37*a* is separated from and does not contact the overseal 64.

In an embodiment, the apex point 35*a* is located between the BDISP 37*a* and the overseal 64, wherein the overseal 64 does not contact the apex point 35*a* and the overseal 64 does not contact the BDISP 37*a*.

The distance between the apex point 35*a* to the top edge of the overseal 64 is defined as distance W shown in FIG. 3. In an embodiment, the distance W has a length from 0 mm, or greater than 0 mm, or 2.0 mm, or 4.0 mm to 6.0 mm, or 8.0 mm, or 10.0 mm or 15.0 mm.

When more than four webs are used to produce the container, the portion 68 of the overseal 64 may be a 4-ply, or a 6-ply, or an 8-ply portion.

The gusseted side panels 18, 20 adjoin the front panel 22 and the rear panel 24 along peripheral seals to form a chamber.

Each peripheral seal has (i) a body seal inner edge (BSIE) with a bottom end and an opposing top end. (ii) A bottom tapered seal inner edge (b-TSIE) extends from the BSIE bottom end. A top tapered seal inner edge (t-TSIE) extends from the BSIE top end. The t-TSIE has a length that is at least 1.1 times greater than the length of the BSIE (in mm).

In an embodiment, a bottom corner arc is present between each BSIE and its respective b-TSIE.

Figure 6:
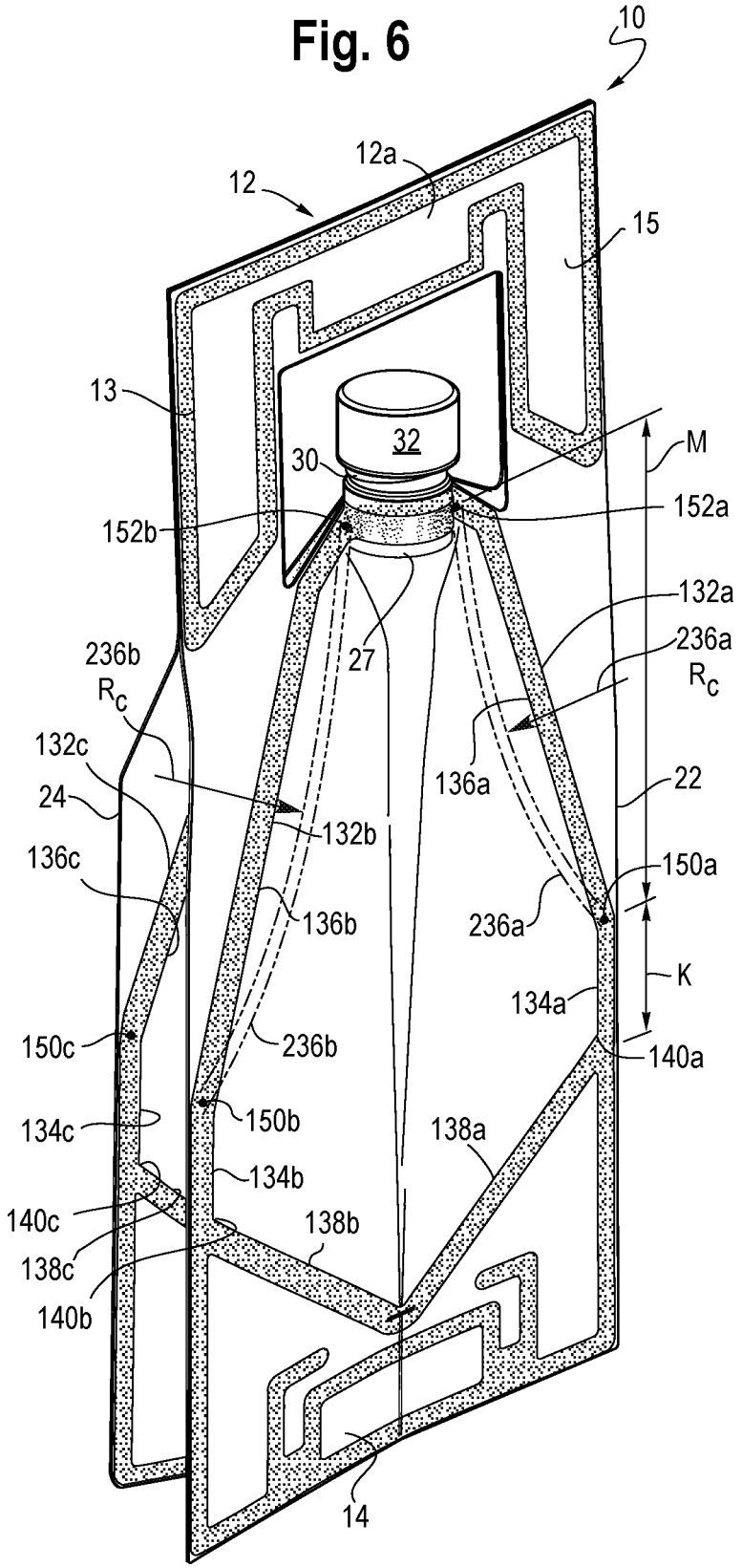
FIG. 6 is a perspective view of the flexible container of FIG. 5, partially expanded to show the body seal inner edges.

The peripheral seals 41 shown in FIG. 1 are described in further detail in in FIGS. 5, and 6. In FIGS. 5 and 6, the peripheral seals 41 of FIG. 1 are identified individually as peripheral seals 132*a*, 132*b*, 132*c*, and 132*d*. Each peripheral seal 132*a*-132*d* has opposing ends, a top end and a bottom end. Each peripheral seal 132*a*-132*d* includes a respective body seal inner edge (BSIE) 134*a*, 134*b*, 134*c*, and 134*d*. Each peripheral seal 132*a*-132*d* further includes a respective tapered seal inner edge (TSIE) extending from the bottom end and from the top end of each respective BSIE. TSIEs 136*a*, 136*b*, 136*c*, 136*d* extend from the top end of each respective BSIE 134*a*-134*d* and are hereafter collectively referred to as "t-BSIE." TSIEs 138*a*, 138*b*, 138*c*, and 138*d* extend from the bottom end of each respective BSIE and are hereafter collectively referred to "b-TSIE."

A corner arc 140*a*-140*d* (or "CA 140*a*-140*d*") extends between each BSIE and TSIE to connect, or otherwise adjoin, each b-TSIE to its respective BSIE end. The flexible container 10 has four corner arcs (or CAs), 140*a*-140*d*. As best shown in FIG. 5, CA 140*a* extends between BSIE 134*a* and *b*-TSIE 138*a*. CA 140*a* connects BSIE 134*a* to *b*-TSIE 138*a*. It is understood that CAs 140*b*-140*d* connect respective BSIEs and TSIEs in a similar manner as shown and described with respect to CA 140*a*. It is further understood that corner arcs 140*a*-140*d* are distinct from the distal inner seal arcs 39*a*, 39*c* in the bottom seal area.

The flexible container 10 has BSIEs 134*a*-134*d*. Each BSIE 134*a*-134*d* has a length. The length of a BSIE is the distance between the corner arc and a top point of the BSIE. The "top point for the BSIE" (or "top point") is the point where the BSIE ends and the t-TSIE begins. FIGS. 1 and 5 show BSIE 134*a* has a length K from corner arc 140*a* to top point 150*a*. The length for BSIE 134*b*-134*d* is measured in a similar manner. The length for each BSIE 134*a*-134*d* may the same or may be different. In an embodiment, the length for each BSIE 134*a*-134*d* is the same.

The flexible container 10 has t-TSIEs 136*a*-136*d*. Each t-TSIE 136*a*-136*d* has a length. The length of a t-TSIE is the distance between the top point of the BSIE and a neckpoint. The "neckpoint" is the point where the t-TSIE contacts the neck 27. FIGS. 1 and 5 show t-TSIE 136*a* has a length M from top point 150*a* to neckpoint 152*a*. The length for each t-TSIE 136*b*-136*d* is measured in a similar manner. The length for each t-TSIE 136*a*-136*d* may the same or may be different. In an embodiment, the length for each t-TSIE 136*a*-136*d* is the same.

In an embodiment, each BSIE has the same length (e.g., length K) and each t-TSIE has the same length (e.g., length M). Each t-TSIE 136*a*-*d* is from 1.1, or 1.5 or 2.0, or 3.0, or 4.0 or 5.0 to 6.0, or 7.0, or 8.0, or 9.0, or 10.0 times greater in length than the length of its respective BSIE 134*a*-134*d*. In other words M/K is from 1.1, or 1.5 or 2.0, or 3.0, or 4.0 or 5.0, to 6.0, or 7.0, or 8.0, or 9.0, or 10.0.

In an embodiment, the flexible container 10 includes top arcuate tapered seal inner edges (t-ATSIE) 236*a*, 236*b*, 236*c*, and 236*d* as shown in FIGS. 5-6. Each t-ATSIE 236*a*-236*d* has a radius of curvature, Rc. The Rc for each t-ATSIE 236*a*-236*d* may be the same or may be different. The Rc for each of t-ATSIE is from 1.0 mm, or 3.0 mm, or 5.0 mm, or 10.0 mm, or 20.0 mm, or 25.0 mm, or 50.0 mm, or 75.0 mm, or 100.0 mm to 150.0 mm, or 200.0 mm, or 250.0 mm, or 300.0 mm. In an embodiment, the Rc for each t-ATSIE is the same and is from 1.0 mm, or 3.0 mm, or 5.0 mm, or 10.0 mm, or 20.0 mm, or 25.0 mm, or 50.0 mm, or 75.0 mm, or 100.0 mm to 150.0 mm, or 200.0 mm, or 250.0 mm, or 300.0 mm.

In an embodiment, the flexible container 10 has an aspect ratio from 1:1 to 3.0:1. The "aspect ratio," as used herein, is the height of the flexible container divided by the width of the flexible container. The aspect ratio is measured when the flexible container is in an expanded and stand-up configuration (when the container is filled with product, for example) as shown in FIG. 1. In FIG. 1, flexible container 10 is in the expanded and stand-up position. Distance H is the height of the flexible container 10 and distance I is the width of the flexible container 10. The aspect ratio is distance H divided by distance I.

In an embodiment, the flexible container 10 has an aspect ratio from 1:1, or 1.2:1, or 1.2:1, or 1.5:1, to 2.0:1, or 2.5:1, or 3.0:1.

In an embodiment, the flexible container 10 has a volume from 0.25 liters (L), or 0.5 L, or 0.75 L, or 1.0 L, or 1.5 L, or 2.5 L, or 3 L, or 3.5 L, or 4.0 L, or 4.5 L, or 5.0 L to 6.0 L, or 7.0 L, or 8.0 L, or 9.0 L, or 10.0 L, or 20 L, or 30 L.

Figure 7:
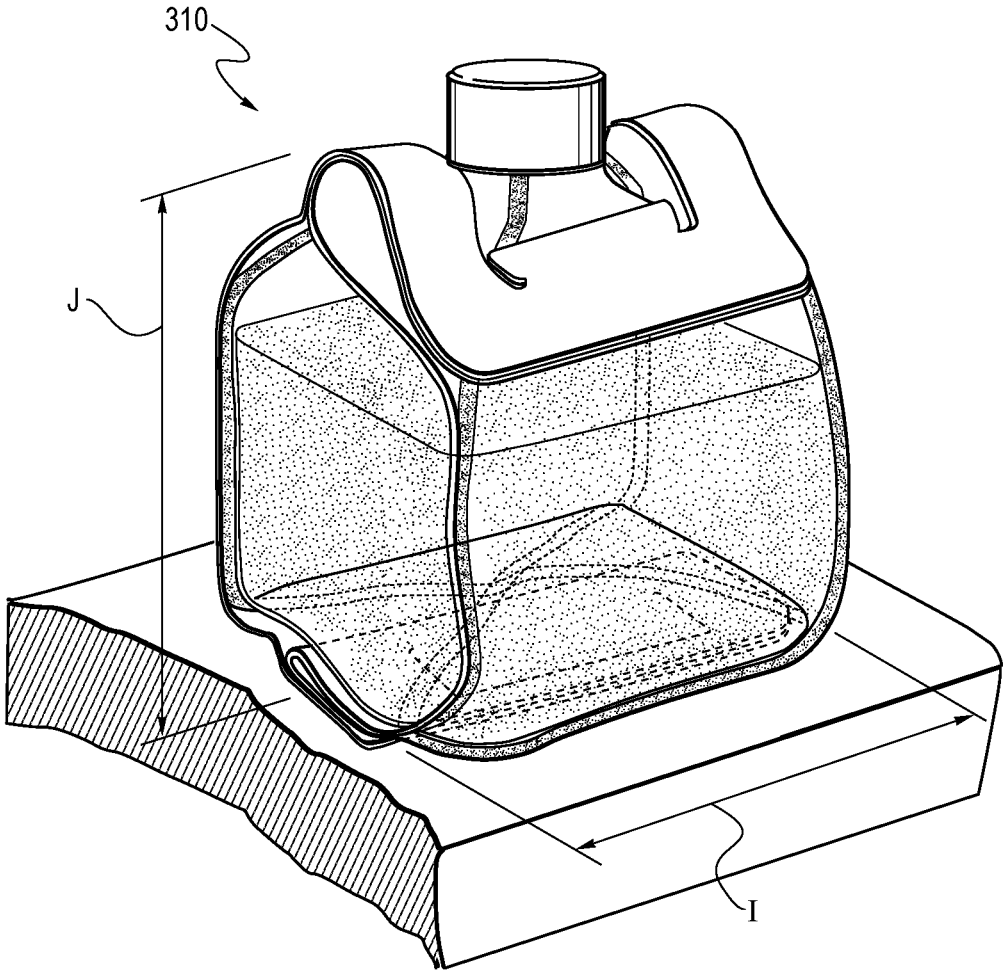
FIG. 7 is a perspective view of a prior art flexible container.

FIG. 7 shows a prior art flexible container 310. Flexible container 10 with t-TSIEs 136*a*-136*d* (or ATSIEs 236*a*-236*d*) exhibit a greater aspect ratio compared to the aspect ratio of the four panel stand-up flexible container 310. Flexible container 310 has a width I that is the same length as the width I of flexible container 10. Container 310 has a height J that is less than the height H of flexible container 10. The aspect ratio H/I of flexible container 10 is greater than the aspect ratio J/I of prior art container 310.

Returning to FIG. 1, FIG. 1 shows an embodiment wherein each BSIE 134*a*-134*d* has a respective BSIE top point 150*a*, 150*b*, 150*c*, and 150*d*. A Plane L extends through all four of the BSIE top points 150*a*-150*d*. The chamber volume (when flexible container 10 is in the expanded configuration) from the bottom segment 26 to the Plane L and bounded by panels 18-24 defines a lower container volume. The lower container volume is greater than 50% of the total volume of the flexible container 10. In this way, Plane L defines a lower container volume that is greater than 50% of the total volume to the flexible container 10.

In an embodiment, the lower container volume is from 51 vol %, or 53 vol % or 55 vol %, or 60 vol %, to 65 vol %, or 70 vol %, or 75 vol % of the total volume of flexible container 10.

The flexible container 10 can be used to store any number of flowable substances therein. In particular, a flowable food product can be stored within the flexible container 10. In one aspect, flowable food products such as salad dressings, sauces, dairy products, mayonnaise, mustard, ketchup, other condiments, beverages such as water, juice, milk, or syrup, carbonated beverages, beer, wine, animal feed, pet feed, and the like can be stored inside of the flexible container 10.

The flexible container 10 is suitable for storage of other flowable substances including, but not limited to, oil, paint, grease, chemicals, cleaning solutions, washing fluids, suspensions of solids in liquid, and solid particulate matter (powders, grains, granular solids).

The flexible container 10 is suitable for storage of flowable substances with higher viscosity and requiring application of a squeezing force to the container in order to discharge. Nonlimiting examples of such squeezable and flowable substances include grease, butter, margarine, soap, shampoo, animal feed, sauces, and baby food.

By way of example, and not by limitation, some embodiments of the present disclosure will now be described in detail in the following Examples.

EXAMPLES

Two flexible containers (comparative sample and example 1) are produced with the respective geometries of (i) flexible container 310 (shown in FIG. 7) and (ii) the present flexible container 10 as shown in FIGS. 1-6. The dimensions of each flexible container are provided in Table 1 below.

Tip test. A non-slip matt is affixed to a board. A filled flexible container is placed on the non-slip matt. One end of the board is raised by hand (raised end) and the other end of the board (stationary end) remains in contact with a horizontal support surface. The tip point is determined when the flexible container begins to lift from the raised board. A photograph is taken of the flexible container on the raised board at the tip point. The angle of the board to the horizontal support surface is measured in Adobe Illustrator™. The result of the tip test is reported as the tip angle (in degrees) between the board and the horizontal surface and the tip point.

The tip test is performed for side-tip (gusset panel toward stationary end) and face-tip (front panel toward stationary end) for (i) flexible containers filled with polyethylene pellets and (ii) flexible containers filled with water. Results are shown in Table 1 below.

Billboard area. Each flexible container is filled with polyethylene pellets. A front facing photograph is taken for each of the two flexible containers (comparative sample, example 1), with the respective geometries of flexible container 310 and present flexible container 10. The photographs are imported into Adobe Illustrator™. A shape is drawn around the outside perimeter of the front face for each flexible container. A shape is drawn around the perimeter of void for the top handle. Logic within Adobe Illustrator™ calculates the area of the front face shape and also calculates the area of the top handle void. The area of the top handle void is subtracted from the area of the front face and is reported as "billboard area" in Table 1 below.

Aspect Ratio. In Table 1, the aspect ratio for the comparative sample and example 1, is calculated by dividing the value for "vertical rest height to top of spout" by the value for "footprint width."

TABLE 1

| | Comparative sample | Example 1 |
|---|---|---|
| Flexible container geometry | 310+ (FIG. 7) | 10 (FIGS. 1-6) |
| Vertical (corner to corner dim)* | 14.0 | n/a |
| Vertical Rest Height to top of handle* | 27.6 | 33.0 |
| Vertical Rest Height to top of Spout* | 21.6 | 29.2 |
| Footprint Depth* | 15.2 | 15.2 |
| Footprint Width* | 16.5 | 16.5 |
| Aspect ratio | 1.6 | 2.0 |
| Container + Cap Weight (oz) | | 2.35 |
| Fill Weight Pellets (oz.) | 81.7 | 81.7 |
| Fill Weight Water (oz.) | 137.1 | 135.7 |
| Tip angle | | |
| Side-tip Pellets (in degrees) | 33 | 26 |
| Face-tip Pellets (in degrees) | 31 | 23.5 |
| Side-tip Water (in degrees) | 18 | 15 |
| Face-tip Water (in degrees) | 17 | 12 |
| Billboard area | | |
| Front Face (sq inches) | 62.572 | 72.44 |
| Minus top handle void (sq inches) | 4.436 | 4.45 |
| Billboard area (sq inches) | 58.14 | 67.99 |

*dimensions in centimeters (cm)
+container 310 (prior art)

It is specifically intended that the present disclosure not be limited to the embodiments and illustrations contained herein, but include modified forms of those embodiments including portions of the embodiments and combinations of elements of different embodiments as come with the scope of the following claims.

The invention claimed is:

1. A flexible container comprising:

(A) a front panel, a rear panel, a first gusseted side panel, and a second gusseted side panel, the gusseted side panels adjoining the front panel and the rear panel along peripheral seals to form a chamber;

(B) each peripheral seal having (i) a body seal inner edge (BSIE) with a bottom end and an opposing top end, (ii) a bottom tapered seal inner edge (b-TSIE) extending from the BSIE bottom end;

(iii) a top tapered seal inner edge (t-TSIE) extending from the BSIE top end to a neckpoint; and (C) the t-TSIE has a length that is at least two times greater than a length of the BSIE (in mm);

wherein each BSIE top end has a top point; and a plane containing all four BSIE top points defines a lower container volume, the lower container volume is at least 51% of a total volume of the flexible container.

2. The flexible container of claim 1 wherein the length of the t-TSIE is from to 10 times greater than the length of the BSIE.

3. The flexible container of claim 2 wherein the flexible container comprises four BSIEs and each BSIE has a respective t-TSIE extending from the BSIE top end.

4. The flexible container of claim 1 comprising a handle.

5. The flexible container of claim 1 comprising a top handle and a bottom handle.

6. The flexible container of claim 5 wherein the top handle is a stand-up top handle.

7. The flexible container of claim 1 wherein each t-TSIE is a top arcuate tapered seal inner edge (t-ATSIE) having a radius of curvature, Rc, from 1.0 mm to 300 mm.

8. The flexible container of claim 1 having an aspect ratio from 2.0:1 to 3.0:1.

9. A flexible container comprising:

(A) a front panel, a rear panel, a first gusseted side panel, and a second gusseted side panel, the gusseted side panels adjoining the front panel and the rear panel along peripheral seals to form a chamber, a portion of each panel terminates at a neck;

(B) each peripheral seal having (i) a body seal inner edge (BSIE) with a bottom end and an opposing top end, (ii) a bottom tapered seal inner edge (b-TSIE) extending from the BSIE bottom end;

(iii) a top tapered seal inner edge (t-TSIE) extending from the BSIE top end to the neck; and (C) the t-TSIE has a length (in mm) that is from two to 10 times greater than a length of the BSIE.

10. The flexible container of claim 9 wherein each BSIE top end has a top point; and a plane containing all four BSIE top points defines a lower container volume, the lower container volume is at least 51% of the total volume of the flexible container.

* * * * *